US006120896A

United States Patent [19]

Jorkasky et al.

[11] Patent Number: 6,120,896

[45] Date of Patent: Sep. 19, 2000

[54] PROCESS OF MAKING HIGH NITRILE COMPOSITE FILAMENTS

[75] Inventors: Richard J. Jorkasky, Hudson; George S. Li, Solon; Elena Simona Percec, Chagrin Falls, all of Ohio

[73] Assignee: The Standard Oil Company, Chicago, Ill.

[21] Appl. No.: 09/212,493

[22] Filed: Dec. 17, 1998

Related U.S. Application Data

[62] Division of application No. 08/989,347, Dec. 12, 1997, Pat. No. 5,902,530.

[51] Int. Cl.[7] ..... D02G 3/00

[52] U.S. Cl. ..... 428/373; 428/374

[58] Field of Search ..... 428/373, 374, 428/364

[56] References Cited

U.S. PATENT DOCUMENTS

| | | |
|---|---|---|
| 2,439,815 | 4/1948 | Sisson . |
| 3,038,236 | 6/1962 | Breen . |
| 3,038,240 | 6/1962 | Breen . |
| 3,182,106 | 5/1965 | Fujita . |
| 3,547,763 | 12/1970 | Hoffman . |
| 3,720,576 | 3/1973 | Fujisaki . |
| 3,737,504 | 6/1973 | Herrbach . |
| 3,785,919 | 1/1974 | Hickman . |
| 3,849,044 | 11/1974 | Ando . |
| 3,861,843 | 1/1975 | Kevchel . |
| 3,864,447 | 2/1975 | Sikiguchi . |
| 3,940,543 | 2/1976 | Chimuna . |
| 4,020,139 | 4/1977 | Ross . |
| 4,052,146 | 10/1977 | Skernberg . |
| 4,510,204 | 4/1985 | Duke . |
| 5,017,116 | 5/1991 | Carter . |

FOREIGN PATENT DOCUMENTS

| | | |
|---|---|---|
| 7-238422 | 9/1995 | Japan . |

OTHER PUBLICATIONS

Orientation Suppression—H. Brody, Journal Applied Polymer Science vol. 31, 1986.

Morphology, Sorption Characteristics—Siahkohlah & Walsh, NCSU–Raleigh, undated.

Permeability of Oxygen & Water Vapor Kamal–Jinnah–, 1984 McGill Univ. Montreal–Polymer Engineiring & Science Dec. 1994 vol. 24.

Dictionary of Fiber & Textile Technology –(2) undated Hoechst Celamese, 1990.

AcrylicFiber Technology–Masson–Marcel Dekker Inc, 1995 Polypropylene Fibers Science—M. Ahmed, undated.

Structure & Properties of Oriented Polymers—Ward Univ of Leeds, undated Essentials of Textiles Joseph–Cal State Northridge, 1998, pp. 29–30, 132.

*Primary Examiner*—William Krynski
*Assistant Examiner*—J. M. Gray
*Attorney, Agent, or Firm*—Stephen L. Hensley; Joseph DiSalvo

[57] ABSTRACT

A novel composite high-nitrile fiber in which the polymers are arranged in a sheath core type configuration. One polymer of the composite filament comprises a solventless, waterless, melt-processable acrylonitrile olefinically unsaturated polymer and the other polymer of the composite filament comprises an organic polymer. Either polymer can be employed as the sheath or the core component of the composite filament.

14 Claims, No Drawings

PROCESS OF MAKING HIGH NITRILE COMPOSITE FILAMENTS

Division of Ser. No. 08/989,347 filed Dec. 12, 1997 now U.S. Pat. 5,902,530.

BACKGROUND OF THE INVENTION

The invention relates to a novel filament and configuration of such filament, more particularly to a composite high-nitrile filament. Filaments herein mean filaments composed of two or more polymers arranged in a sheath core type configuration wherein the sheath is composed of a polymer that is different than the polymer that makes up the core. In particular, one polymer comprises a solventless, waterless, melt-processable acrylonitrile olefinically unsaturated polymer and the other polymer comprises an organic polymer.

The unique composite high-nitrile filament provides improved dyeabiltiy; and improved resistance to abrasion, solvents, gas and ultraviolet light. The high-nitrile filaments are employed to form high-nitrile composite fibers which, in turn, can be used as knitted, woven or nonwoven objects.

Bicomponent acrylic fibers known in the art are exemplified by U.S. Pat. No. 3,547,763, U.S. Pat. No. 4,020,139, and Japanese patent application 6[1994]-189,463. U.S. Pat. No. 3,547,763 relates to bi-component acrylic fibers having a modified helical crimp. Each component is selected from a group consisting of (1) polyacrylonitrile and (2) copolymers of at least 88% acrylonitrile and 12% of copolymerizable monomers.

U.S. Pat. No. 4,020,139 relates to a process for melt spinning a plurality of eccentric sheath core filaments. The process selects filaments to be converged into a yarn so as to avoid contact between the thin sheath regions of the filament during conversion.

Japanese patent application 6[1994]-189,463 discloses anti-static acrylic fibers with a sheath core structure made by a solution solvent process. The sheath component consists of an acrylonitrile based copolymer, and the core component consists of an acrylonitrile based copolymer and a multifunctional polyether ester.

Difficulties in the development of composite high-nitrile filaments are due to the fact that polymers of different composition types are often incompatible with each other. The use of two different polymers, even with similar chemical characteristics, in a composite filament often results in the generation of internal stresses, thereby inducing the composite filament to split. Prior art composite acrylic filaments are limited because of poor fiber formation. Additionally, melt spinning composite filaments is problematic because many of the polymers have low resistance to thermal degradation.

It is advantageous to produce a high-nitrile composite fiber wherein one of the polymers employed as the sheath or the core component is a solventless, waterless melt-processable acrylonitrile olefinically unsaturated polymer. Furthermore, the high nitrile composite filaments of the instant invention have improved processability and, in particular, improved spinnabilty. These and other advantages will become apparent as the description of the invention proceeds.

SUMMARY OF THE INVENTION

The present invention relates to a composite high-nitrile filament comprising two or more polymers in a sheath core relation. One polymer of the composite filament comprises an organic polymer; and the other polymer comprises a solventless, waterless, melt processable acrylonitrile olefinically unsaturated polymer comprising about 50% to about 95% by weight polymerizable acrylonitrile monomer and at least one of about 5% to about 50% by weight polymerizable olefinically unsaturated monomer. The sheath and core polymer are continuous along the length of the filament.

DETAILED DESCRIPTION OF THE INVENTION

In accordance with the present invention, the high-nitrile composite filament comprises an organic polymer and a waterless, solventless melt-processable acrylonitrile olefinically unsaturated polymer in a core sheath configuration.

The organic polymer includes, but is not limited to, synthetic and natural polymers. The synthetic polymer includes, but is not limited to, polyolefins such as polypropylene, polyethylene and poly (4-methlpentene-1); polyesters such as polyethylene terephthalate (PET) polybutylene terephthalate (PBT), and polyethylene naphthalate (PEN); polyamides (PA), including aliphatics and aromatics, such as nylons; polycarbonates such as polybisphenol-A carbonate (PC); polyimides (PI) such as polyetherimide aliphatic and aromatic; poly (amide-imides); poly (ester-imides); polystyrenes (PS); polyurethanes; polyvinyl chloride (PVC); polyketones; polyphenylene oxide (PPO); polyvinyl alcohol (PVA); polysulphone; liquid crystalline polymers such as copolyesters of hydroxy-benzoic acid with 2,6 naphthoic acid (Vectra); Kevlar® (available from DuPont); acrylonitrile containing polymers including a waterless, solventless melt processable acrylonitrile olefinically unsaturated polymer or an acrylonitrile containing polymer that is soluble in a solvent; and the like. The natural polymer includes, but is not limited to, wool, silk, cotton, cellulosic fibers and the like.

The monomers employed in the organic polymer can be one monomer or a combination of monomers dependent upon the properties desired to impart to the composite filaments end use. The organic polymer is employed as either the sheath or the core component of the composite filament, but not both.

The other polymer employed is a waterless, solventless melt-processable acrylonitrile olefinically unsaturated polymer comprising an acrylonitrile monomer polymerized with at least one olefinically unsaturated monomer (hereinafter "acrylonitrile olefinically unsaturated polymer"). The acrylonitrile olefinically unsaturated polymer is employed as the core or the sheath or both, however if it is employed as both the core and sheath polymers then different compositions of the polymer must be used for the core and the sheath. The acrylonitrile olefinically unsaturated polymer is preferably made up of about 50 weight % to about 95 weight %, preferably about 75 weight % to about 93 weight %, and most preferably about 85 weight % to about 92 weight % of polymerized acrylonitrile monomer, and at least one of about 5 weight % to about 50 weight %, preferably about 7 weight % to about 25 weight %, and most preferably about 8 weight % to about 15 weight % of polymerized olefinically unsaturated monomer.

The olefinically unsaturated monomer employed is one of more of an olefinically unsaturated monomer with a C=C double bond polymerizable with an acrylonitrile monomer. The olefinically unsaturated monomer can be a single polymerizable monomer resulting in a co-polymer, or a combination of polymerizable monomers resulting in a multipolymer. The choice of olefinically unsaturated monomer or a combination of monomers depends upon the properties desired to impart to the resulting filament and its fiber end use.

The olefinically unsaturated monomer generally includes, but is not limited to, acrylates such as methyl acrylates and ethyl acrylates; methacrylates, such as methyl methacrylate; acrylamides and methacrylamides and each of their N-substituted alkyl and aryl derivatives, such as acrylamide, methacrylamide, N-methylacrylamide, N,N-dimethyl acrylamide; maleic acid and its derivatives, such as N-phenylmaleimide; vinylesters, such as vinyl acetate; vinylethers, such as ethyl vinyl ether and butyl vinyl ether; vinylamides, such as vinyl pyrrolidone; vinylketones, such ethyl vinyl ketone and butyl vinyl ketone; styrenes, such as methylstyrene, stryene and indene; halogen containing monomers, such as vinyl chloride, vinyl bromide, and vinylidene chloride; ionic monomers, such sodium vinylsulfonate, sodium styrenesulfonate, and sodium methyl sulfonate; acid containing monomers such as itaconic acid, styrene sulfonic acid and vinyl sulfonic acid; base-containing monomers, such as vinyl pyridine, 2-aminoethyl-N-acrylamide, 3-aminopropyl-N-acrylamide, 2-aminoethylacrylate, 2-aminoethymethacrylate; and olefins, such as propylene, ethylene, isobutylene.

An exemplary method to make the melt-processable high-nitrile multipolymer is described in U.S. Pat. No. 5,602,222 entitled "A Process for Making a Polymer of Acrylonitrile/Methacrylonitrile/Olefinically Unsaturated Monomers" and U.S. Pat. No. 5,618,901 entitled "A Process for Making a High Nitrile Multipolymer Prepared from Acrylonitrile and Olefinically Unsaturated Monomers," both incorporated herein by reference.

The core polymer is a dissimilar composition in comparison to the sheath polymer. The organic polymer and the acrylonitrile olefinically unsaturated polymer are thermally stable in relationship to each other. The organic polymer or the acrylonitrile olefinically unsaturated polymer is either the core component or the sheath component of the composite filament depending on the application and on the chemical and physical properties of the polymers such as melt flow characteristics, molecular weight, composition and the like. In the invention, the core polymer in the filament is in the range of about 1% weight to about 99% weight, preferably about 5% weight to about 95% weight and more preferable about 10% weight to about 90% weight of the filament. The sheath polymer in the filament is in the range of about 99% weight to about 1% weight, preferably about 95% weight to about 5% weight and more preferable about 90% weight to about 10% weight of the filament. The minimum amount of sheath polymer is such that the core polymer is not exposed on the filament surface. Distribution of the core polymer and sheath polymer is uniform and homogenous throughout the composite filament.

The composition of the polymer used for the sheath and the composition of the polymer used for the core are prepared separately. The acrylonitrile olefinically unsaturated polymer is prepared by known polymerization processes. The organic polymer is prepared by known polymerization processes.

The acrylonitrile olefinically unsaturated polymer is melt processed in a waterless, solventless system; however trace amounts of water as an impurity may exist up to 3%, preferably 1% or less. The process of producing the high-nitrile composite filament of this invention comprises extruding each of the organic polymer and the acrylonitrile olefinically unsaturated polymer. The organic polymer and the acrylonitrile olefinically unsaturated polymer are extruded either as a co-mixture or as separate mixtures. This is determined by each polymer's composition; for instance, if the polymer composition for the sheath and the polymer composition for the core are immiscible due to molecular weight, melt viscosity or chemical or physical properties, then the sheath polymer and the core polymer are co-mixed and extruded into a spinnerette that forms core sheath configurations. If the sheath polymer and the core polymer compositions are sufficiently compatible to interact due to molecular weight, melt viscosity or chemical or physical properties, then the polymers are processed in separate extruders. Then each polymer stream is separately extruded into a spinnerette that receives each separate stream to form a core sheath configuration. In another embodiment, if the core polymer is a preformed fiber, then the sheath polymer is extruded and spun onto the preformed fiber by using a spinnerette that sheathes the preformed filament core. The spinnerettes have from one to multiple thousands of holes, and the holes may be further formed to a specific shape so the existing core sheath filament has a profiled shape.

The temperature in each zone of extrusion and spinning is dependent on the thermal degradation temperature of the composition of the sheath polymer and the core polymer. The composite filaments can have any desired cross section, dependent on the spinnerette employed and the end use of the fiber.

The composite filaments from the spinnerette are then collected as a fiber bundle at a fixed speed. The composite fiber bundle proceeds to other conventional processing steps such as drawing, heating, cooling, relaxing, finishes and the like, as desired for end product use of the composite fiber. Such processing steps can be done sequentially or intermittently. The composite filament can be oriented drawing the composite filament on one or more rolls at accelerated speeds. The composite filament can be alternatively oriented by gravity or a blast of high velocity gas, air or the like. The composite filament can be heat set to relieve the internal stresses of the filament. The composite filament can be relaxed either after orienting, simultaneously with heat setting or after heat setting. Conventional texturizing methods can be employed on the composite filament. The composite high-nitrile filament may be further modified by the use of various dyes, pigments, delustering agents, lubricants, adhesives, additives, stabilizers and the like. Additional treatment may be employed to further modify the characteristics of the composite filament, so long as such steps do not have a deleterious effect on the properties of the composite high-nitrile filament.

SPECIFIC EMBODIMENT

The following examples demonstrate the advantages of the present invention.

Acrylonitrile olefinically unsaturated polymer employing about 85% acrylonitrile and about 15% methyl acrylate resin crumb and polypropylene pellets, made by Fina with an 18 melt flow index, were extruded as a co-mixture through about a 1.25 inch extruder with four zones and a die. The zone temperatures and die temperature were set at about 185°/185°/185°/185°/185° C. The resulting extrudate yielded a polypropylene core encapsulated by an acrylonitrile olefinically unsaturated polymer sheath.

The composite filaments were examined by optical microscopy using a Leitz cross polarizing optical microscope (Laborlux 12 pol) equipped with a Mettler hot stage.

It was determined by optical microscopy that the composite filament had a core/sheath configuration. The sheath polymer appeared as a continuous layer encapsulating the core polymer. The sheath was slightly discolored and when chipped off revealed a white polypropylene core.

The composition of the sheath was confirmed via differential scanning calorimetry employing a Perkin Elmer DSC7 equipped with a computerized data station. The thermogram of the sheath indicated that it exhibited a glass transition temperature of about 84.3° C., a melting temperature at about 226° C., and a crystallization temperature at about 186.9° C. which are the properties of the polymerized acrylonitrile methyl acrylate polymer.

Differential scanning calorimetry analysis of the core indicated the material melted at about 165.1° C. and crystallized at about 107.4° C. which are the properties of the polypropylene.

The results showed a continuous layer of sheath polymer which encapsulated the core polymer. Further, the results show that the sheath polymer was acrylonitrile methyl acrylate polymer and that the core polymer was polypropylene. Further, the results showed that each polymer was uniformly distributed in a sheath/core configuration.

From the above description and examples of the invention, those skilled in the art will perceive improvements, changes, and modifications in the invention. Such improvements, changes and modifications within those skilled in the art are intended to be covered by the appended claims.

What is claimed:

1. A composite high-nitrile filament comprising two or more polymers arranged in a sheath/core configuration wherein the sheath polymer composition is different than the core polymer composition, and wherein one of the polymers comprises an organic polymer and a second polymer comprises a solventless, waterless, melt-processable acrylonitrile olefinically unsaturated polymer comprising about 50% to about 95% by weight polymerizable acrylonitrile monomer and at least one of about 5% to about 50% by weight polymerizable olefinically unsaturated monomer and wherein the organic polymer and the acrylonitrile olefinically unsaturated polymer are thermally stable in relationship to each other.

2. The filament of claim 1 wherein the sheath polymer is selected from the group consisting of the acrylonitrile olefinically unsaturated polymer, the organic polymer and combinations thereof.

3. The filament of claim 1 wherein the core polymer is selected from the group consisting of the acrylonitrile olefinically unsaturated polymer, the organic polymer and combinations thereof.

4. The filament of claim 1 wherein the core component is in the range of about 1% to about 99% weight of the filament.

5. The filament of claim 1 wherein the sheath component is in the range of about 99% weight to about 1% weight of the filament.

6. The filament of claim 1 wherein the distribution of sheath polymer and the core polymer are each continuous and uniform along the length of the filament, and each is homogenous throughout the filament.

7. The filament of claim 1 wherein the olefinically unsaturated monomer is selected from a group consisting of methylacrylates, ethylacrylates, acrylamides and methyl acrylamides and each of their substituted alkyl and aryl derivatives, maleic acid and its derivatives, vinylesters, vinylethers, vinylamides, vinylketones, styrenes, halogen-containing monomers, ionic monomers, acid-containing monomers, base-containing monomers, olefins and combinations thereof.

8. The filament of claim 7 wherein the olefinically unsaturated monomer is selected from the group consisting of methyl methacrylate, acrylamide, methacrylamide, N-methylacrylamide, N,N-dimethyl acrylamide, N-phenylmaleimide; vinyl acetate, ethyl vinyl ether and butyl vinyl ether, vinyl pyrrolidone, ethyl vinyl ketone, butyl vinyl ketone, methylstyrene, stryene, indene, vinyl chloride, vinyl bromide, vinylidene chloride, sodium vinylsulfonate, sodium styrenesulfonate, sodium methyl sulfonate, itaconic acid, styrene sulfonic acid, vinyl sulfonic acid, vinyl pyridine, 2-aminoethyl-N-acrylamide, 3-aminopropyl-N-acrylamide, 2-aminoethylacrylate, 2-aminoethymethacrylate, propylene, ethylene, isobutylene and combinations thereof.

9. The filament of claim 1 wherein the organic polymer is selected from the group consisting of polyolefins, polyesters, polyimides, polycarbonates, polyamides, polyamide-imides, polyester-imides, polystyrenes, polyurethanes, polyvinyl chloride, polyvinyl alcohol, polyketones, polyphenylene oxide, polysulphone, acrylonitrile-containing polymers, liquid crystalline polymers, cellulosic, wood, silk, cotton and combinations thereof.

10. The filament of claim 9 wherein the organic polymer is selected from the group consisting of polypropylene, polyethylene, poly (4-methylpentene-1), polyethylene terephthalate, polybutylene terephthalate, polyethylene naphthalate, nylon, polybisphenol-A carbonate; polyetherimide, copolyester of hydroxy-benzoic acid with 2,6 naphthoic acid, solventless, waterless, melt-processable acrylonitrile containing polymers and combinations thereof.

11. The filament of claim 1 wherein the core component is in the range of about 5% weight to about 95% weight of the filament.

12. The filament of claim 1 wherein the core component is in the range of about 10% weight to about 90% weight of the filament.

13. The filament of claim 1 wherein the sheath component is in the range of about 95% weight to about 5% weight of the filament.

14. The filament of claim 1 wherein the sheath component is in the range of about 90% weight to about 10% weight of the filament.

* * * * *